US006363533B1

(12) United States Patent
DeLuca

(10) Patent No.: US 6,363,533 B1
(45) Date of Patent: Apr. 2, 2002

(54) EXTENDED USE-LIFE IMPROVED TIE

(76) Inventor: Stefano DeLuca, Viale Campania, 40 Milan (IT)

( * ) Notice: Subject to any disclaimer, the term of this patent is extended or adjusted under 35 U.S.C. 154(b) by 0 days.

(21) Appl. No.: 09/787,521

(22) PCT Filed: Sep. 23, 1999

(86) PCT No.: PCT/IT99/00297

§ 371 Date: Mar. 19, 2001

§ 102(e) Date: Mar. 19, 2001

(87) PCT Pub. No.: WO00/18261

PCT Pub. Date: Apr. 6, 2000

(30) Foreign Application Priority Data

Sep. 28, 1998 (IT) ..... MI98U0632

(51) Int. Cl.[7] ..... A41D 25/08
(52) U.S. Cl. ..... 2/152.1; 2/145
(58) Field of Search ..... 2/144, 145, 152.1, 2/153, 155, 156

(56) References Cited

U.S. PATENT DOCUMENTS

| | | | | | |
|---|---|---|---|---|---|
| 2,874,386 | A | * | 2/1959 | Loomis | 2/150 |
| 4,897,887 | A | * | 2/1990 | Chen et al. | 2/150 |
| 5,461,726 | A | * | 10/1995 | Wade | 2/144 |
| 5,778,453 | A | * | 7/1998 | Chen | 2/148 |
| 5,836,018 | A | * | 11/1998 | Lee | 2/144 |

FOREIGN PATENT DOCUMENTS

| | | | | |
|---|---|---|---|---|
| DE | 212099 | * | 7/1909 | 2/144 |

* cited by examiner

*Primary Examiner*—John J. Calvert
*Assistant Examiner*—Tejash Patel
(74) *Attorney, Agent, or Firm*—Hedman & Costigan, P.C.

(57) ABSTRACT

An extended use-life improved tie comprises a first tie flap (2) made of an impermeable and flexible material operatively coupled to a rigid element (3), said rigid element being coupled to one or more tie flap (4, 5) having end portions (6, 7) which can be coupled to one another.

8 Claims, 4 Drawing Sheets

EXTENDED USE-LIFE IMPROVED TIE

BACKGROUND OF THE INVENTION

The present invention relates to an extended use-life improved tie.

As is known, a tie is a garment accessory article which is broadly used by men.

A tie conventionally comprises a single cloth sheet element having a cross size which varies along the tie length.

This tie forming sheet element or flap is usually made of silk, wool or other fabric materials and is conventionally provided with a lot of patterns and colors.

Prior ties, on the other hand, are affected by several drawbacks.

In fact, to be properly worn, prior ties require a lot of complex manual operations, to be performed in front of a mirror.

Moreover, during the day, a tie knot tends to loose, thereby forcing the user to perform periodical control or monitoring operations in order to adjust the proper position of said tie knot.

Moreover, prior ties are susceptible to be anti-aesthetically creased, because of the varying positions of the tie user.

That same drawback occurs upon a long use of the tie.

In this case, said tie, at the knotting portion thereof, is undesirably creased or wrinkled, thereby preventing good aesthetic effects from being obtained.

A further drawback is that the tie is very difficult to be properly cleaned, in a case of an accidental stain, since the fabric material used for making the tie must be usually dry-cleaned.

Actually, a stain on the tie would cause objectable aesthetic drawbacks.

SUMMARY OF THE INVENTION

Accordingly, the aim of the present invention is to overcome the above mentioned drawbacks.

For achieving the above mentioned aim, the invention specifically relates to an improved tie, which has been designed for a long duration use-life, which can be easily fitted to the user neck, at a low cost, anti-creasing features and, moreover, that is quickly and simply cleaned.

According to the present invention, an improved tie, specifically designed for a long duration use-life, comprises a first tie flap made of an impermeable and flexible material, said first tie flap being operatively coupled to a rigid element, said rigid element being in turn coupled to one or more flaps having end portions which can be coupled to one another.

This improved tie provides the following main advantages.

The tie can be fitted to the user neck in a very simple and quick manner, and it will hold its proper fitted arrangement through the overall day.

Moreover, the subject tie will have always a very good aesthetic aspect, even if it is stored in a case, and this owing to the material designed for making it.

Moreover, the tie is very useful in a journey application.

Furthermore, the subject tie can be easily and quickly cleaned, by simply using water and soap, and it can be easily dried by any suitable type of cloth piece.

Since the subject tie is made of an impermeable material, it can be easily washed without damaging the tie.

Finally, the making cost of the subject tie is very small owing to the easy availability of the used materials.

In addition, the subject tie can be easily coloured and decorated by screen printing methods, allowing to reproduce on the tie material a lot of different phantasy patterns.

BRIEF DESCRIPTION OF THE DRAWINGS

Further characteristics and advantages of the improved tie according to the present invention will become more apparent hereinafter from the following detailed disclosure of a preferred embodiment thereof, which is illustrated, by way of an indicative, but not limitative, example, in the accompanying drawings, where.

DESCRIPTION OF THE PREFERRED EMBODIMENTS

Figures 1, 2:
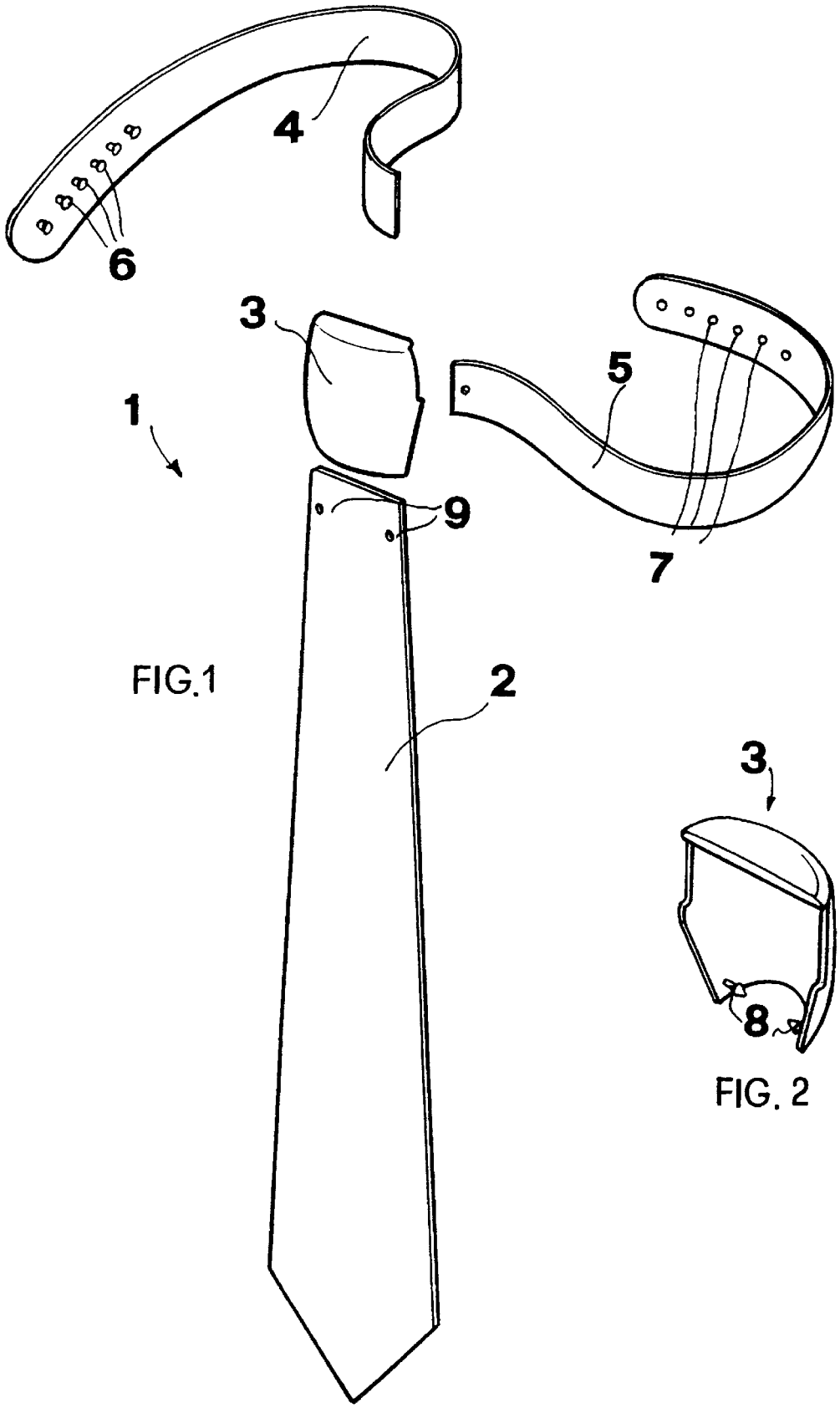
FIG. 1 is an exploded perspective view of the improved extended use-life tie according to the present invention.
FIG. 2 is a rear perspective view of a detail of the tie according to the invention.
Figure 3:
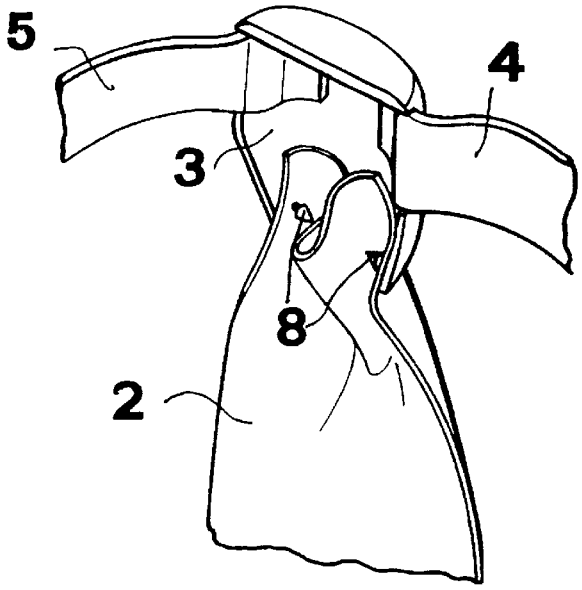
FIG. 3 is a further partial rear perspective view of the tie according to the invention.
Figure 4:
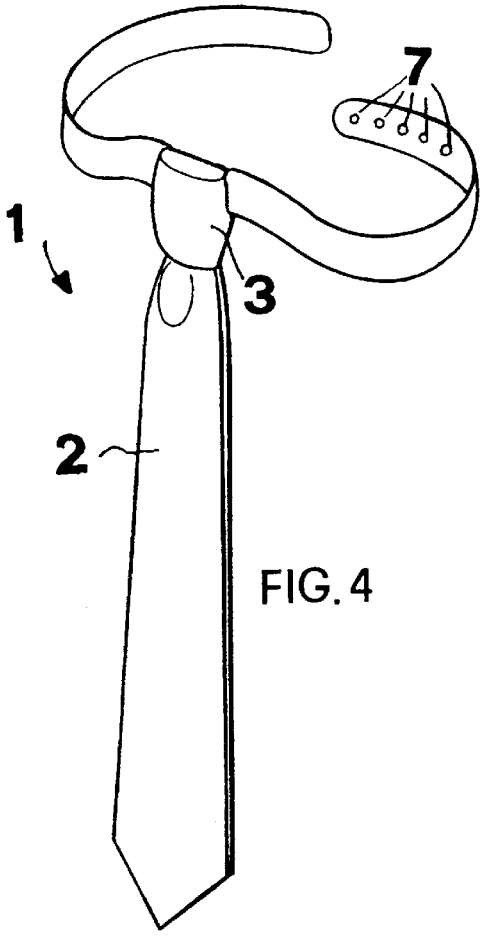
FIG. 4 is a front perspective view of the tie shown in FIG. 1.
Figure 5:
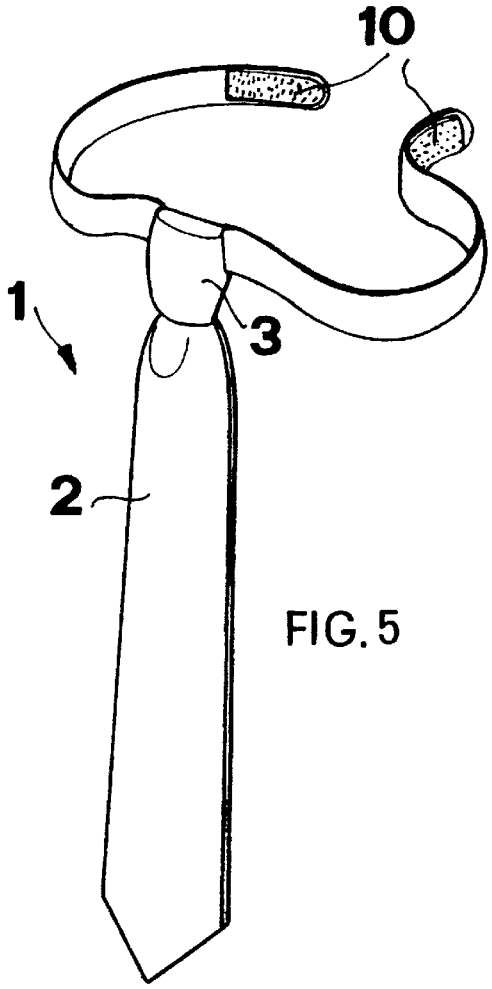
FIG. 5 is a further front perspective view of that same tie.

With reference to the number references of the above mentioned figures, the improved tie 1, which is specifically suitable for a long duration use-life, comprises a first tie flap 2, which is advantageously made of an impermeable and flexible material, for example a rubber or rubber-like copolymeric material, or a woven or non-woven material, coupled with a rubber or rubber polymeric material.

The first tie flap 2, can be coloured and have any desired fancy pattern, that has a polygonal configuration symmetrical along the longitudinal axis thereof, and having a variable width.

At an end portion thereof, the first tie flap 2 is provided with two holes 9 designed for coupling with the tie flap 2 to a rigid central element 3, preferably made of a plastic material.

The central element 3 has the shape of a conventional tie knot, with inside thereof comprising two projecting elements 8, being shaped as small cones, that couple with the holes 9 of the first tie flap 2.

In this connection it should be apparent that the element 3 could be provided with graphic patterns like those of the tie flap 2, for meeting any desired chromatic requirements.

The element 3 are operatively coupled to two flaps 4 and 5, of substantially rectangular configuration and having a width less than that of the first tie flap 2, thereby the flaps 4 and 5 can be easily engaged under the collar of a shirt.

The flaps 4, 5, which are preferably, but not necessarily, made of the same material forming the first tie flap 2, are coupled to the central element 3 by glueing or by any other mechanical equivalent means.

The flaps also comprise mechanical means for connecting said flaps to one another thereby allowing the tie 1 to be fitted on the user shirt.

More specifically, the mechanical means can comprise a plurality of buttons 6 and corresponding buttonholes 7, respectively made on the flap 4 and flap 5, or vice-versa.

By changing the button 6 engaged on a given buttonhole 7, it is possible to fit the tie 1 to the user neck, in a very simple manner.

Alternately, at the free-end portions of the flaps 4 and 5, it would be also possible to provide non-woven fabric portions 10, of a reversible joining type, designed for allowing the flaps 4, 5 to be easily coupled to one another.

Alternately, the flaps 4, 5 can be replaced by a single flap, coupled, at the central portion thereof, to the element 3, by glueing or any like coupling means.

The flap is moreover provided, at its end portions, with the same mutual joining mechanical means.

The configuration and shape of the elements forming the subject tie, can vary depending on requirements, without departing from the scope of the invention.

The use of the subject tie 1 would be self-evident from the preceding disclosure.

Actually, after having coupled the projecting elements 8 of the central element 3 to the holes 9 of the flap 2, the collar of the shirt will be upward raised, to allow the flaps 4 and 5 to be coupled at the rear thereof by the coupling means 6, 7 or 10.

Then, the collar of the shirt will be lowered again.

The thus fitted tie 1, owing to its features, will always be held in a desired fitting arrangement.

If the tie is accidentally stained, then the tie flap 2 can be immediately washed by simply using water and soap, and then it can be dried by using a dry cloth piece.

Thus, the tie 1 will be recovered to a perfectly clean and ordered condition.

Figure 6:
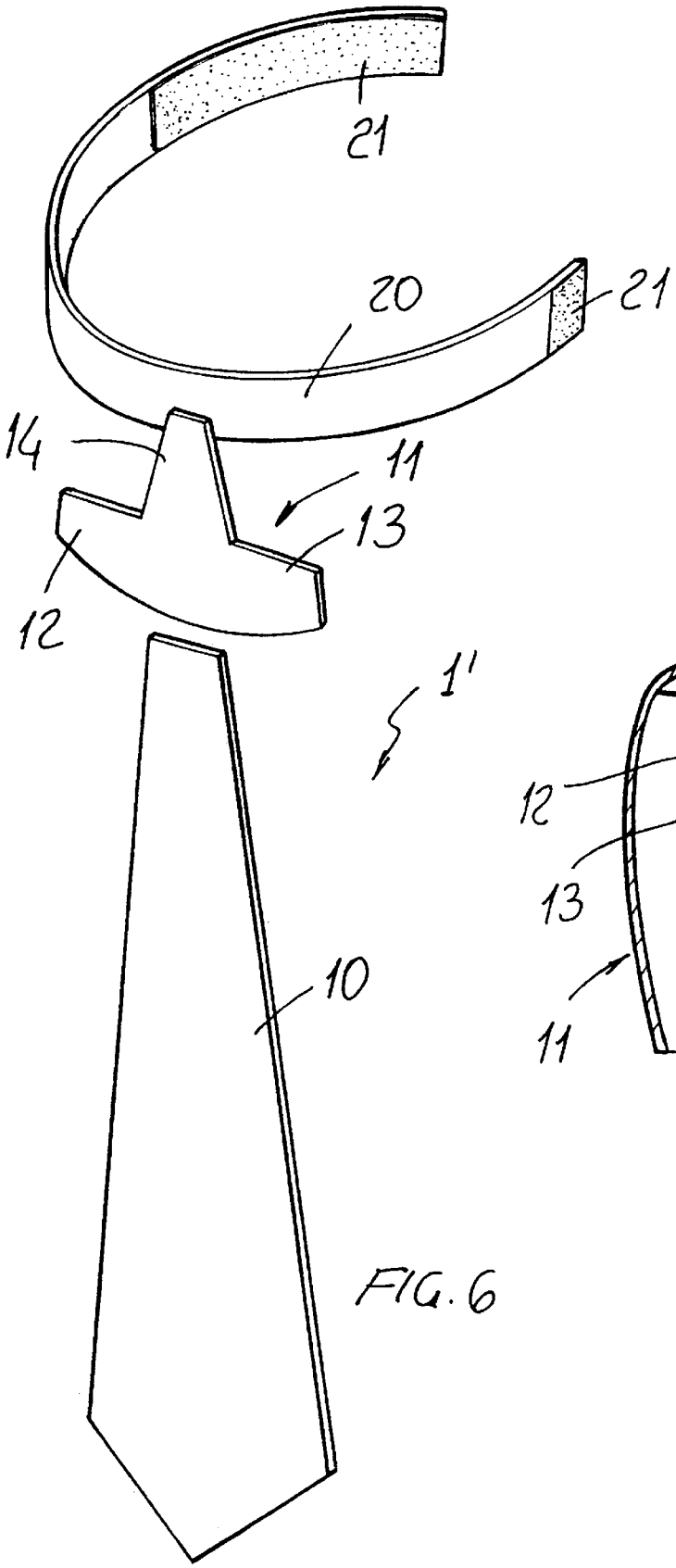
FIG. 6 is another exploded perspective view illustrating a further embodiment of the subject improved tie.
Figure 9:
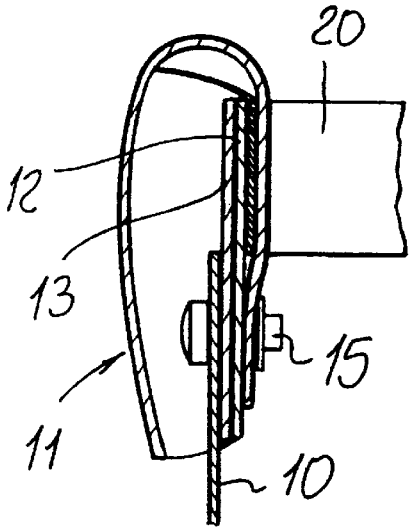
FIG. 9 is a cross sectional view of the subject tie taken substantially at an edge portion thereof.
Figure 8:
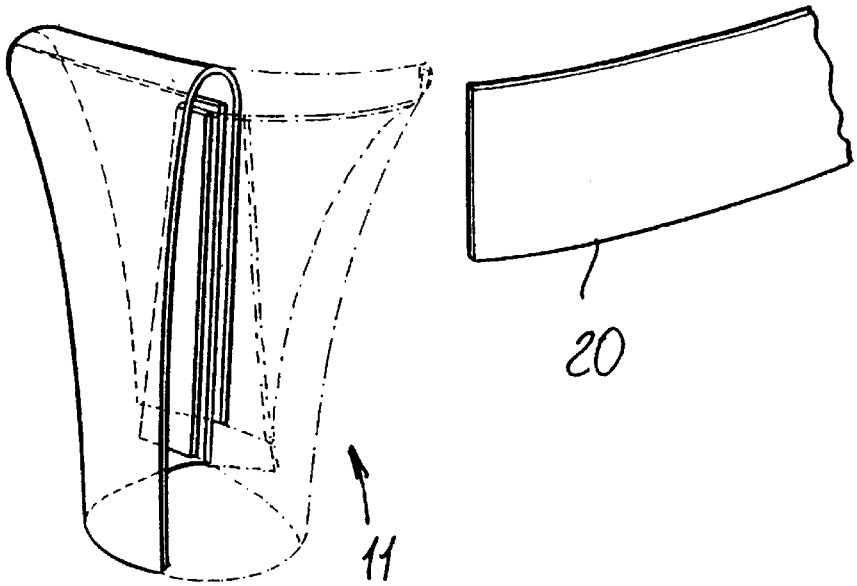
FIG. 8 is a partially broken away view illustrating the tie knot of the tie shown in FIG. 6.
Figure 8:
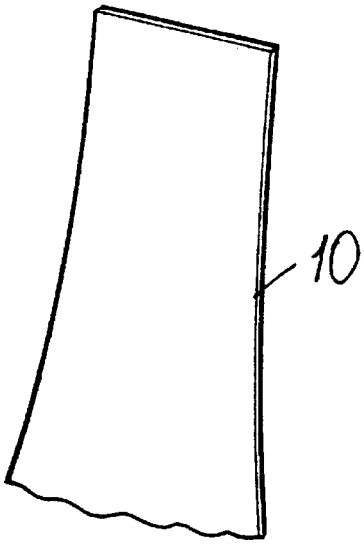
Figure 7:
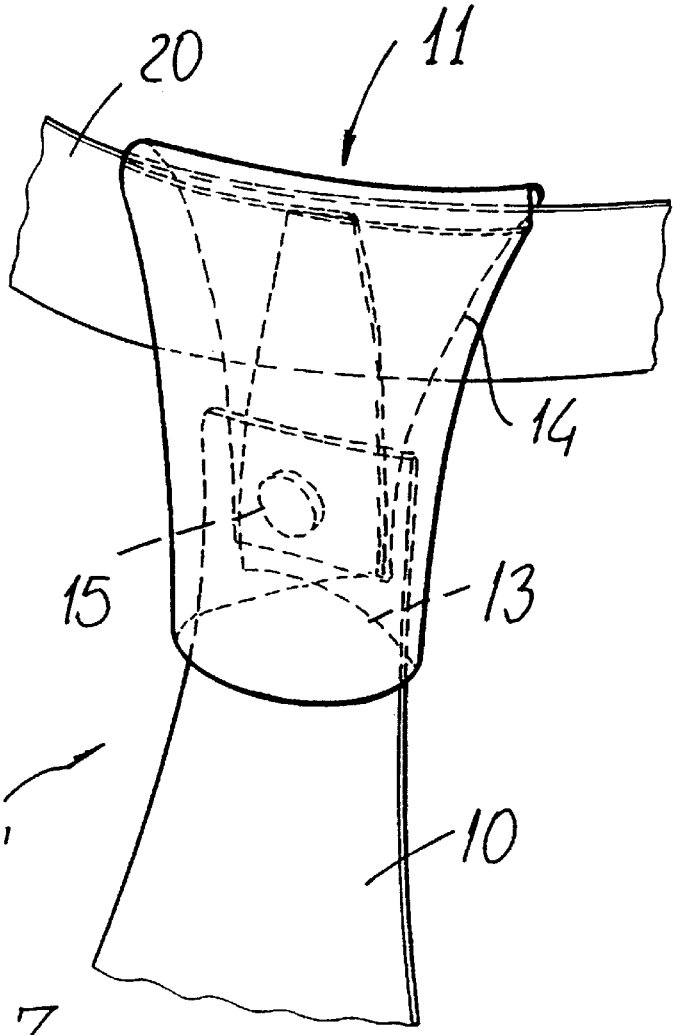
FIG. 7 is a perspective view of a tie knot being formed.

According to the embodiment shown in FIGS. 6 to 9, the improved tie, herein generally indicated by the reference number 1', comprises an elongated tie flap 10, also made of a flexible impermeable material such as rubber, rubber polymeric compounds, woven or non-woven materials coupled to rubber or rubber polymeric compounds, which flap can bear thereon any desired fancy patterns or colours.

The elongated flap 10, in particular, is provided for coupling with a middle element 11, having a substantially T-shape body, in order to define a first and second legs 12 and 13, opposite to one another and adapted to be folded onto one another, thereby defining that portion of the tie knot facing the elongated flap 10.

A stem 14 is moreover provided to be folded to define a loop arrangement for joining the first and second legs, by a joining pin elements 15, also adapted to connect the elongated flap 10.

The middle element is so folded as to define a tie knot configuration which is made very stable by the coupling pin 15.

The bridging element defined by the stem 14 will allow a strip-like element 20 to be easily engaged therein, said strip-like element being provided, at the end portions thereof, with tearable web portions for providing a desired connection.

From the above disclosure it should be apparent that the invention fully achieves the intended aim and, in particular, by using flexible and impermeable materials, it is possible to provide a configuration like that of a conventional tie, while providing the possibility of including any types of desired fancy patterns and colours, while providing a tie having a nearly infinite duration.

Alternately, the knot or central element 3 can be made of a rubber or plastics material, either molded or cured, which is easily connected to one or more flaps constituting the body of the subject tie.

What is claimed is:

1. An extended use tie, comprising a first tie flap having a polygonal configuration having a longitudinal symmetry with varying width, constructed of an impermeable and flexible material, the first tie flap being adapted to be operatively coupled to a central element, having a tie knot shape, and the knot shape being coupled to two second flaps each having end portions engageable with one another, characterized in that the first tie flap is provided, at one end thereof with two holes, wherein the knot shape is provided with cone-shape projecting elements for engaging in said holes, and wherein said central element is a hollow half shell rigid element.

2. A tie according to claim 1, characterized in that said two second flaps are coupled at one end thereof to said central element and, an opposite free end thereof being provided with adjusting coupling means for coupling.

3. A tie according to claim 2, characterized in that the coupling means comprise a plurality of buttons and corresponding buttonholes.

4. A tie according to one of claims 1 or 2, characterized in that the first and second flaps, are selected from the group of rubber material, non-woven or woven material; and the central element being plastic and/or rubber.

5. A tie according to claim 1, characterized in that said central element is directly molded to the flaps of the tie body.

6. An tie comprising an elongated flap made of an impermeable and flexible material and adapted to be operatively coupled to a middle element, characterized in that the middle element comprises a sheet element having a substantially T shape which is foldable for simulating a tie knot and defining a passage for a strip like element which is closable on itself.

7. An tie according to claim 6, characterized in that said T-shape element is provided with a pair of opposite legs which are foldable onto one another to define a bottom portion of the tie knot and a foldable stem is provided for forming a loop for allowing said strip element to pass therethrough, wherein the foldable stem and legs are coupled by a coupling pin provided for connecting the elongated flap.

8. A tie according to claim 6, characterized in that said strip-like element is provided, at the end portions thereof, with tearable web portions.

* * * * *